US006672368B2

(12) United States Patent
Unal

(10) Patent No.: US 6,672,368 B2
(45) Date of Patent: Jan. 6, 2004

(54) CONTINUOUS CASTING OF ALUMINUM

(75) Inventor: Ali Unal, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 92 days.

(21) Appl. No.: 10/078,638

(22) Filed: Feb. 19, 2002

(65) Prior Publication Data

US 2002/0153123 A1 Oct. 24, 2002

Related U.S. Application Data

(60) Provisional application No. 60/270,262, filed on Feb. 20, 2001.

(51) Int. Cl.[7] ..... B22D 11/06; B22D 11/124

(52) U.S. Cl. ..... 164/480; 164/459; 164/428

(58) Field of Search ..... 164/480, 428, 164/900, 459

(56) References Cited

U.S. PATENT DOCUMENTS

| | | | | |
|---|---|---|---|---|
| 4,002,197 A | | 1/1977 | Hazelett et al. | 164/250 |
| 4,238,248 A | | 12/1980 | Gyöngyös et al. | 148/2 |
| 4,341,261 A | * | 7/1982 | Thomson et al. | 164/475 |
| 4,823,860 A | | 4/1989 | Lauener | 164/480 |
| 4,828,012 A | | 5/1989 | Honeycutt, III et al. | 164/479 |
| 5,370,171 A | | 12/1994 | Fields et al. | 164/312 |
| 5,515,908 A | | 5/1996 | Harrington | 164/481 |
| 5,518,064 A | | 5/1996 | Romanowski et al. | 164/453 |
| 5,564,491 A | | 10/1996 | Harrington | 164/481 |
| 5,934,359 A | | 8/1999 | Strezov | 164/480 |
| 6,044,896 A | | 4/2000 | Harrington | 164/428 |
| 6,120,621 A | | 9/2000 | Jin et al. | 148/437 |
| 6,193,818 B1 | | 2/2001 | Legresy et al. | 148/551 |

FOREIGN PATENT DOCUMENTS

| | | | |
|---|---|---|---|
| WO | 97/14520 | 4/1997 | B22D/11/06 |

OTHER PUBLICATIONS

"Alumitech '97", The Aluminum Association, Inc., 2nd International Aluminum Conference and Trade Exposition, May 20–23, 1997, The INFORUM, Atlanta, GA, pp. 447–457.

Haga, Toshio et al, "High–Speed Roll Caster for Strip Casting of Aluminum Alloy", Materials Science Forum, vols. 331–337 (2000) pp. 185–190.

Haga, Toshio et al, "High Speed Roll Caster for Aluminum Alloy Strip", Aluminum Alloys, vol. 1, pp. 327–332.

Moon, Hee–Kyung et al., "Development of Strip Casting Process at POSCO/RIST", Strip Casting Project Team, Research Institute of Industrial Science & Technology, Republic of Korea, pp. 1–6.

* cited by examiner

*Primary Examiner*—M. Alexandra Elve
*Assistant Examiner*—Len Tran
(74) *Attorney, Agent, or Firm*—Julie W. Meder; Edward L. Levine

(57) ABSTRACT

A method of continuous casting aluminum alloys between a pair of rolls. Molten aluminum alloy is delivered to a roll bite between the rolls and passes into the roll nip in a semi-molten state. A solid strip of cast aluminum alloy exits the nip at speeds of about 25 to about 400 feet per minute. Thin gauge (0.07–0.25 inch) strip may be produced at rates of up to 2000 pounds per hour per inch of cast strip width.

43 Claims, 13 Drawing Sheets

(1 of 13 Drawing Sheet(s) Filed in Color)

Development of roll force for Alloy 1 (Al-Fe-Ni-Si-Zn)

Development of roll force for Alloy 2 (Al-Mg-Mn-Cu-Fe-Si)

Segregation of eutectic forming elements Si, Fe, Ni and Zn

Segregation of peritectic forming elements Ti, V and Zr

X25

X100

X25

X100

Segregation of eutectic forming elements Mg, Mn, Cu, Fe and Si

Segregation of peritectic forming elements Ti and V

CONTINUOUS CASTING OF ALUMINUM

RELATED APPLICATION

This application claims the benefit of U.S. Provisional Patent Application Ser. No. 60/270,262 filed Feb. 20, 2001 entitled "Continuous Casting of Aluminum".

FIELD OF THE INVENTION

The present invention relates to continuous casting of aluminum alloys, more particularly, to continuous casting aluminum alloys between two cooled rolls at speeds of over 25 feet per minute

BACKGROUND OF THE INVENTION

Continuous casting of metals such as aluminum alloys is performed in twin roll casters, block casters and belt casters. Twin roll casting of aluminum alloys has enjoyed good success and commercial application despite the relatively low production rates achievable to date. The present invention is directed to a method of continuous casting aluminum which surpasses the productivity of twin roll casting and reaches a level comparable to or better than the productivity of belt casting.

Twin roll casting traditionally is a combined solidification and deformation technique involving feeding molten metal into the bite between a pair of counter-rotating cooled rolls wherein solidification is initiated when the molten metal contacts the rolls. Solidified metal forms as a "freeze front" of the molten metal within the roll bite and solid metal advances towards the nip, the point of minimum clearance between the rolls. The solid metal passes through the nip as a solid sheet. The solid sheet is deformed by the rolls (hot rolled) and exits the rolls.

Aluminum alloys have successfully been roll cast into ¼ inch thick sheet at about 4–6 feet per minute or about 50–70 pounds per hour per inch of cast width (lbs/hr/in). Attempts to increase the speed of roll casting typically fail due to centerline segregation. Although it is generally accepted that reduced gauge sheet (e.g. less than about ¼ inch thick) potentially could be produced more quickly than higher gauge sheet in a roll caster, the ability to roll cast aluminum at rates significantly above about 70 lbs/hr/in has been elusive.

Typical operation of a twin roll caster at thin gauges is described in U.S. Pat. No. 5,518,064 (incorporated herein by reference) and depicted in FIGS. 1 and 2. A molten metal holding chamber H is connected to a feed tip T which distributes molten metal M between water-cooled twin rolls $R_1$ and $R_2$ rotating in the direction of the arrows $A_1$ and $A_2$, respectively. The rolls $R_1$ and $R_2$ have respective smooth surfaces $U_1$ and $U_2$; any roughness thereon is an artifact of the roll grinding technique employed during their manufacture. The centerlines of the rolls $R_1$ and $R_2$ are in a vertical or generally vertical plane L (e.g. up to about 15° from vertical) such that the cast strip S forms in a generally horizontal path. Other versions of this method produce strip in a vertically upward direction. The width of the cast strip S is determined by the width of the tip T. The plane L passes through a region of minimum clearance between the rolls $R_1$ and $R_2$ referred to as the roll nip N. A solidification region exists between the solid cast strip S and the molten metal M and includes a mixed liquid-solid phase region X. A freeze front F is defined between the region X and the cast strip S as a line of complete solidification.

In conventional roll casting, the heat of the molten metal M is transferred to the rolls $R_1$ and $R_2$ such that the location of the freeze front F is maintained upstream of the nip N. In this manner, the molten metal M solidifies at a thickness greater than the dimension of the nip N. The solid cast strip S is deformed by the rolls $R_1$ and $R_2$ to achieve the final strip thickness. Hot rolling of the solidified strip between the rolls $R_1$ and $R_2$ according to conventional roll casting produces unique properties in the strip characteristic of roll cast aluminum alloy strip. In particular, a central zone through the thickness of the strip becomes enriched in eutectic forming elements (eutectic formers) in the alloy such as Fe, Si, Ni, Zn and the like and depleted in peritectic forming elements (Ti, Cr, V and Zr). This enrichment of eutectic formers (i.e. alloying elements other than Ti, Cr, V and Zr) in the central zone occurs because that portion of the strip S corresponds to a region of the freeze front F where solidification occurs last and is known as "centerline segregation". Extensive centerline segregation in the as-cast strip is a factor that restricts the speed of conventional roll casters. The as-cast strip also shows signs of working by the rolls. Grains which form during solidification of the metal upstream of the nip become flattened by the rolls. Therefore, roll cast aluminum includes grains with multiaxial (non-equiaxed) structure.

The roll gap at the nip N may be reduced in order to produce thinner gauge strip S. However, as the roll gap is reduced, the roll separating force generated by the solid metal between the rolls $R_1$ and $R_2$ increases. The amount of roll separating force is affected by the location of the freeze front F in relation to the roll nip N. As the roll gap is reduced, the percentage reduction of the metal sheet is increased, and the roll separating force increases. At some point, the relative positions of the rolls $R_1$ and $R_2$ to achieve the desired roll gap cannot overcome the roll separating force, and the minimum gauge thickness has been reached for that position of the freeze front F.

The roll separating force may be reduced by increasing the speed of the rolls in order to move the freeze front F downstream towards the nip N. When the freeze front is moved downstream (towards the nip N), the roll gap may be reduced. This movement of the freeze front F decreases the ratio between the thickness of the strip at the initial point of solidification and the roll gap at the nip N, thus decreasing the roll separating force as proportionally less solidified metal is being compressed and hot rolled. In this manner, as the position of the freeze front F moves towards the nip N, a proportionally greater amount of metal is solidified and then hot rolled at thinner gauges. According to conventional practice, roll casting of thin gauge strip is accomplished by first roll casting a relatively high gauge strip, decreasing the gauge until a maximum roll separating force is reached, advancing the freeze front to lower the roll separating force (by increasing the roll speed) and further decreasing the gauge until the maximum roll separating force is again reached, and repeating the process of advancing the freeze front and decreasing the gauge in an iterative manner until the desired thin gauge is achieved. For example, a 10 millimeter strip S may be rolled and the thickness may be reduced until the roll separating force becomes excessive (e.g. at 6 millimeters) necessitating a roll speed increase.

This process of increasing the roll speed can only be practiced until the freeze front F reaches a predetermined downstream position. Conventional practice dictates that the freeze front F not progress forward into the roll nip N to ensure that solid strip is rolled at the nip N. It has been generally accepted that rolling of a solid strip at the nip N is needed to prevent failure of the cast metal strip S being hot rolled and to provide sufficient tensile strength in the exiting strip S to withstand the pulling force of a downstream winder, pinch rolls or the like. Consequently, the roll separating force of a conventionally operated twin roll caster in which a solid strip of aluminum alloy is hot rolled at the nip N is on the order of several tons per inch of width. Although some reduction in gauge is possible, operation at such high roll separating forces to ensure deformation of the strip at the nip N makes further reduction of the strip gauge very difficult. The speed of a roll caster is restricted by the need to maintain the freeze front F upstream of the nip N and prevent centerline segregation. Hence, the roll casting speed for aluminum alloys has been relatively low.

Some reduction in roll separating force to obtain acceptable microstructure in alloys having high alloying element content is described in U.S. Pat. No. 6,193,818. Alloys having 0.5 to 13 wt. % Si are roll cast into strip about 0.05 to 0.2 inch thick at roll separating forces of about 5000 to 40,000 lbs/in at speeds of about 5 to 9 ft/min. While this represents an advance in roll separating force reduction, these forces still pose significant process challenges. Moreover, the productivity remains compromised and strip produced according to the '818 patent apparently exhibits some centerline segregation and grain elongation as shown in FIG. 3 thereof.

A major impediment to high-speed roll casting is the difficulty in achieving uniform heat transfer from the molten metal to the smooth surfaces $U_1$ and $U_2$. In actuality, the surfaces $U_1$ and $U_2$ include various imperfections which alter the heat transfer properties of the rolls. At high rolling speeds, such nonuniformity in heat transfer becomes problematic. For example, areas of the surfaces $U_1$ and $U_2$ with proper heat transfer will cool the molten metal M at the desired location upstream of the nip N whereas areas with insufficient heat transfer properties will allow a portion of the molten metal to advance beyond the desired location and create nonuniformity in the cast strip.

Thin gauge steel strip has been successfully roll cast in vertical casters at high speeds (up to about 400 feet/min) and low roll separating forces. The rolls of a vertical roll caster are positioned side by side so that the strip forms in a downward direction. In this vertical orientation, molten steel is delivered to the bite between the rolls to form a pool of molten steel. The upper surface of the pool of molten steel is often protected from the atmosphere by means of an inert gas. While vertical twin roll casting from a pool of molten metal is successful for steel, aluminum alloys cannot be cast from a pool of molten aluminum alloy. The molten aluminum in such a pool at the bite of vertical rolls would readily oxidize even when protected. This would change the metallurgical properties of the alloy being cast. Steel alloys are much less susceptible to oxidation problems, and with proper protection from oxidation, can be successfully roll cast.

One suggestion for overcoming this problem of oxidized aluminum in vertical roll casting on a laboratory scale is described in Haga et al., "High Speed Roll Caster for Aluminum Alloy Strip", *Proceedings of ICAA*-6, Aluminum Alloys, Vol. 1, pp. 327–332 (1988). According to that method, a stream of molten aluminum alloy is ejected from a gas-pressurized nozzle directly onto one or both of the twin rolls in a vertical roll caster. Although high speed casting of aluminum alloy strip is reported, a major drawback to this technique is that the delivery rate of the molten aluminum alloy must be carefully controlled to ensure uniformity in the cast strip. When a single stream is ejected onto a roll, that stream is solidified into the strip. If a stream is ejected onto each roll, each stream becomes one half of the thickness of the cast strip. In both cases, any variation in the gas pressure or delivery rate of the molten aluminum alloy results in nonuniformity in the cast strip. The control parameters for this type of aluminum alloy roll casting are not practical on a commercial scale.

Continuous casting of aluminum alloys has been achieved on belt casters at rates of about 20–25 feet per minute at about ¾ inch (19 mm) gauge reaching a productivity level of about 1400 pounds per hour per inch of width. In conventional belt casting as described in U.S. Pat. No. 4,002,197, molten metal is fed into a casting region between opposed portions of a pair of revolving flexible metal belts. Each of the two flexible casting belts revolves in a path defined by upstream rollers located at one end of the casting region and downstream rollers located at the other end of the casting region. In this manner, the casting belts converge directly opposite each other around the upstream rollers to form an entrance to the casting region in the nip between the upstream rollers. The molten metal is fed directly into the nip. The molten metal is confined between the moving belts and is solidified as it is carried along. Heat liberated by the solidifying metal is withdrawn through the portions of the two belts which are adjacent to the metal being cast. This heat is withdrawn by cooling the reverse surfaces of the belts by means of rapidly moving substantially continuous films of water flowing against and communicating with these reverse surfaces.

The operating parameters for belt casting are significantly different from those for roll casting. In particular, there is no intentional hot rolling of the strip. Solidification of the metal is completed in a distance of about 12–15 inches (30–38 mm) downstream of the nip for a thickness of ¾ inch. The belts are exposed to high temperatures when contacted by molten metal on one surface and are cooled by water on the inner surface. This may lead to distortion of the belts. The tension in the belt must be adjusted to account for expansion or contraction of the belt due to temperature fluctuations in order to achieve consistent surface quality of the strip. Casting of aluminum alloys on a belt caster has been used to date mainly for products having minimal surface quality requirements or for products which are subsequently painted.

The problem of thermal instability of the belts is avoided in block casters. Block casters include a plurality of chilling blocks mounted adjacent to each other on a pair of opposing tracks. Each set of chilling blocks rotates in the opposite direction to form a casting region therebetween into which molten metal is delivered. The chilling blocks act as heat sinks as the heat of the molten metal transfers thereto. Solidification of the metal is complete about 12–15 inches downstream of the entrance to the casting region at a thickness of ¾ inch. The heat transferred to the chilling blocks is removed during the return loop. Unlike belts, the chilling blocks are not functionally distorted by the heat transfer. However, block casters require precise dimensional control to prevent gaps between the blocks which cause nonuniformity and defects in the cast strip.

This concept of transferring the heat of the molten metal to a casting surface has been employed in certain modified belt casters as described in U.S. Pat. Nos. 5,515,908 and 5,564,491. In a heat sink belt caster, molten metal is delivered to the belts (the casting surface) upstream of the nip with solidification initiating prior to the nip and continued heat transfer from the metal to the belts downstream of the nip. In this system, molten metal is supplied to the belts along the curve of the upstream rollers so that the metal is substantially solidified by the time it reaches the nip between the upstream rollers. The heat of the molten metal and the cast strip is transferred to the belts within the casting region (including downstream of the nip). The heat is then removed from the belts while the belts are out of contact with either of the molten metal or the cast strip. In this manner, the portions of the belts within the casting region (in contact with the molten metal and cast strip) are not subjected to large variations in temperature as occurs in conventional belt casters. The thickness of the strip can be limited by the heat capacity of the belts between which casting takes place. Production rates of 2400 lbs/hr/in for 0.08–0.1 inch (2–2.5 mm) strip have been achieved.

However, problems associated with the belts used in conventional belt casting remain. In particular, uniformity of the cast strip depends on the stability of (i.e. tension in) the belts. For any belt caster, conventional or heat sink type, contact of hot molten metal with the belts and the heat transfer from the solidifying metal to the belts creates instability in the belts. Further, belts need to be changed at regular intervals which disrupts production.

Accordingly, a need remains for a method of high-speed continuous casting of aluminum alloys without using a pair of belts and which achieves uniformity in the cast strip surface.

SUMMARY OF THE INVENTION

This need is met by the method of the present invention of continuous casting aluminum alloy which includes delivering molten aluminum alloy juxtaposed and in communication with a pair of water-cooled rolls arranged in a generally horizontal plane. A reservoir of molten aluminum alloy is advanced towards a nip between the rolls. Outer layers of solid aluminum alloy results on each of the rolls, and a semi-solid aluminum layer is produced in the center between the solid layers. The semi-solid layer includes a molten component and a solid component of broken dendritic arms detached from the solidification front. The solid outer layers and the solid component of the semi-solid aluminum alloy pass through the nip such that a strip of solid aluminum alloy exits the nip while the molten component of the aluminum alloy is urged upstream from the nip. The strip exiting the nip includes a solid central segregated layer sandwiched between the outer conforming solid layers of aluminum alloy. Under typical conditions, the thickness of the center layer is about 20 to about 30% of the total strip thickness. In this manner, a solid strip of aluminum alloy is not produced until the alloy reaches the forming point of the nip. Moreover, unlike in conventional twin roll casters, the rolls do not substantially deform the strip of cast aluminum, a result of which is that the process operates at very low roll separating force.

The molten aluminum alloy has an initial concentration of eutectic forming alloying elements. A result of producing the segregated portion from the broken dendritic arms of the alloy is that this segregated portion is depleted of the eutectic forming alloying elements. The concentration of the eutectic forming alloying elements in the intermediate layer is less than the concentration of the eutectic forming alloying elements in each of the outer layers by as much as about 5 to about 20%.

The strip of metal may exit the nip at a rate of about 25 to about 400 feet (7.7–123 m) per minute or at a rate of about 100 to about 300 feet (30–92 m) per minute. The linear speed at which the solid strip is produced is higher than the linear rate at which the molten aluminum alloy is delivered to the rolls, such as about four times higher than the linear rate of the molten aluminum alloy. The rolls are arranged to cast the strip in a generally horizontal configuration and may be textured with surface irregularities (e.g. grooves, dimples or knurls) about 5 to about 50 microns high and spaced at about 20 to about 120 per inch to enhance heat transfer. The roll separating force is less than about 25 to about 300 pounds per inch of width and may be about 25 to about 200 pounds per inch of width or about 100 pounds per inch of width. The solid strip may be produced in thicknesses of about 0.07 to about 0.25 inch or about 0.08 to about 0.095 inch. The rolls are internally cooled and the contacting surfaces may be oxidized prior to use to provide a continuous and uniform oxide layer thereon. The rolls are brushed periodically or continuously to remove debris that may be deposited during casting. Fixed edge dams and electromagnetic dams may be used to prevent leaking of the molten metal from the sides.

BRIEF DESCRIPTION OF THE DRAWINGS

A complete understanding of the invention will be obtained from the following description when taken in connection with the accompanying drawing figures wherein like reference characters identify like parts throughout.

The file of this patent contains at least one drawing executed in color. Copies of this patent with color drawing (s) will be provided by the Patent and Trademark Office upon request and payment of the necessary fee.

DETAILED DESCRIPTION OF THE INVENTION

For purposes of the description hereinafter, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention includes a method of continuously casting aluminum alloy juxtaposed and in communication with a pair of internally cooled rolls. Conventional twin roll casters for aluminum alloys are operated at rates of about 4–6 feet (1–2 m) per minute or about 50–70 pounds per hour per inch of cast width (lbs/hr/in). The present invention is described in part in reference to conventional roll casters. It is contemplated that a portion of the equipment and the process control parameters for conventional twin roll casting of aluminum alloys may be used when practicing the present invention. However, the present invention requires departure from several aspects of conventional roll casting as detailed below.

Figure 1:
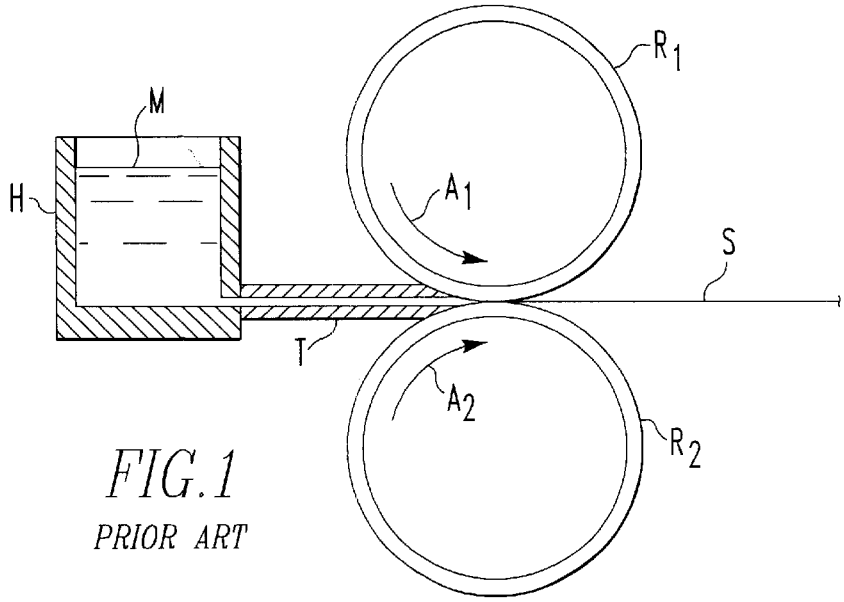
FIG.1 PRIOR ART
FIG. 1 is a schematic of a portion of a caster with a molten metal delivery tip and a pair of rolls.
Figure 2:
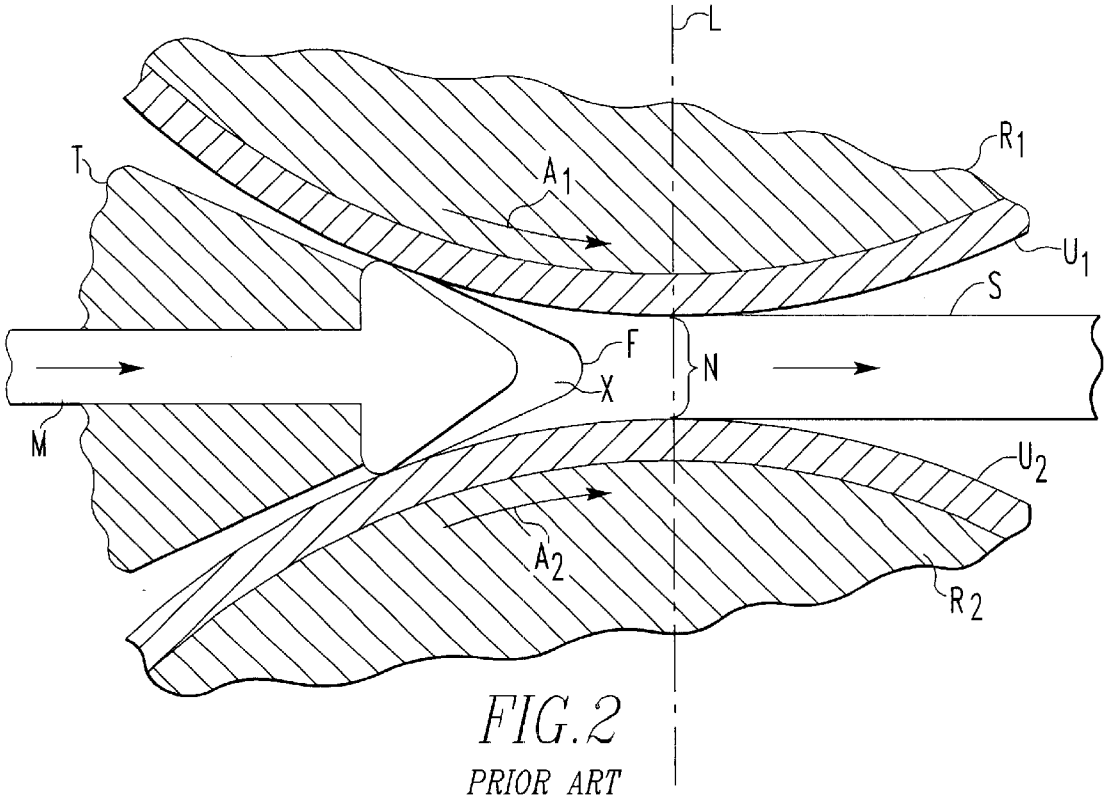
FIG.2 PRIOR ART
FIG. 2 is an enlarged cross-sectional schematic of the molten metal delivery tip and rolls shown in FIG. 1 operated according to the prior art.
Figure 3:
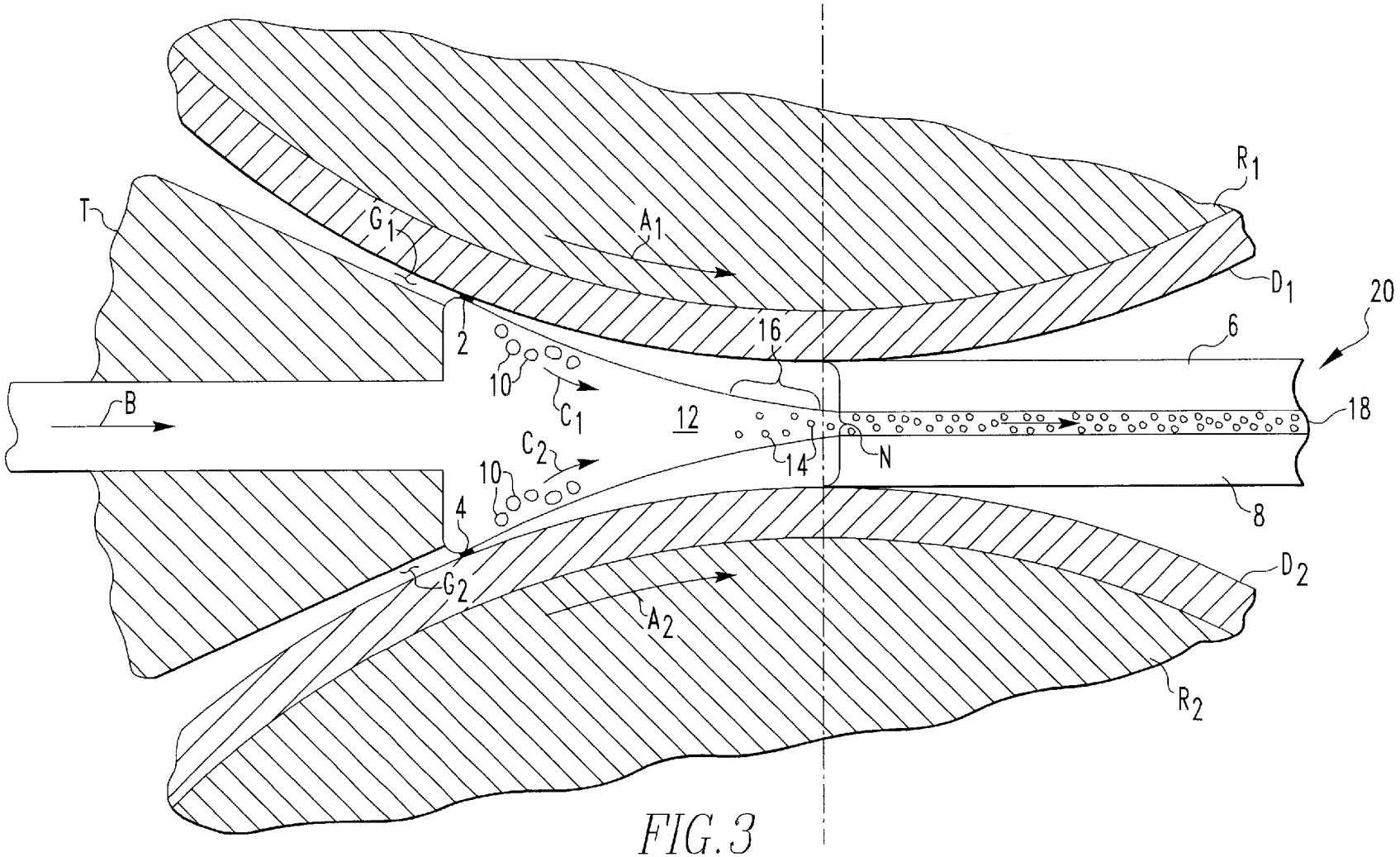
FIG. 3 is an enlarged cross-sectional schematic of the molten metal delivery tip and rolls shown in FIG. 1 operated according to the present invention.

Referring to FIG. 1 (which generically depicts horizontal continuous casting according to the prior art and according to the present invention), the present invention is practiced using a pair of counter-rotating cooled rolls $R_1$ and $R_2$ rotating in the directions of the arrows $A_1$ and $A_2$, respectively. By the term horizontal, it is meant that the cast strip is produced in a horizontal orientation or at an angle of plus or minus about 30° from horizontal. As shown in more detail in FIG. 3, a feed tip T, which may be made from a ceramic material, distributes molten metal M in the direction of arrow B directly onto the rolls $R_1$ and $R_2$ rotating in the direction of the arrows $A_1$ and $A_2$, respectively. Gaps $G_1$ and $G_2$ between the feed tip T and the respective rolls $R_1$ and $R_2$ are maintained as small as possible to prevent molten metal from leaking out and to minimize the exposure of the molten metal to the atmosphere along the rolls $R_1$ and $R_2$ yet avoid contact between the tip T and the rolls $R_1$ and $R_2$. A suitable dimension of the gaps $G_1$ and $G_2$ is about 0.01 inch (0.25 mm). A plane L through the centerline of the rolls $R_1$ and $R_2$ passes through a region of minimum clearance between the rolls $R_1$ and $R_2$ referred to as the roll nip N.

The molten metal M directly contacts the cooled rolls $R_1$ and $R_2$ at regions 2 and 4, respectively. Upon contact with the rolls $R_1$ and $R_2$, the metal M begins to cool and solidify. The cooling metal produces an upper shell 6 of solidified metal adjacent the roll $R_1$ and a lower shell 8 of solidified metal adjacent to the roll $R_2$. The thickness of the shells 6 and 8 increases as the metal M advances towards the nip N. Large dendrites 10 of solidified metal (not shown to scale) are produced at the interfaces between each of the upper and lower shells 6 and 8 and the molten metal M. The large dendrites 10 are broken and dragged into a center portion 12 of the slower moving flow of the molten metal M and are carried in the direction of arrows $C_1$ and $C_2$. The dragging action of the flow can cause the large dendrites 10 to be broken further into smaller dendrites 14 (not shown to scale). In the central portion 12 upstream of the nip N referred to as a region 16, the metal M is semi-solid and includes a solid component (the solidified small dendrites 14) and a molten metal component. The metal M in the region 16 has a mushy consistency due in part to the dispersion of the small dendrites 14 therein. At the location of the nip N, some of the molten metal is squeezed backwards in a direction opposite to the arrows $C_1$ and $C_2$. The forward rotation of the rolls $R_1$ and $R_2$ at the nip N advances substantially only the solid portion of the metal (the upper and lower shells 6 and 8 and the small dendrites 14 in the central portion 12) while forcing molten metal in the central portion 12 upstream from the nip N such that the metal is completely solid as it leaves the point of the nip N. Downstream of the nip N, the central portion 12 is a solid central layer 18 containing the small dendrites 14 sandwiched between the upper shell 6 and the lower shell 8. In the central layer 18, the small dendrites 14 may be about 20 to about 50 microns in size and have a generally globular shape.

The three layers of the upper and lower shells 6 and 8 and the solidified central layer 18 constitute a solid cast strip 20. The solid central layer 18 constitutes about 20 to about 30 percent of the total thickness of the strip 20. The concentration of the small dendrites 14 is higher in the solid central layer 18 of the strip 20 than in the semi-solid region 16 of the flow. The molten aluminum alloy has an initial concentration of alloying elements including peritectic forming alloying elements and eutectic forming alloying elements. Alloying elements which are peritectic formers with aluminum are Ti, V, Zr and Cr. All other alloying elements are eutectic formers with aluminum, such as Si, Fe, Ni, Zn, Mg, Cu and Mn. During solidification of an aluminum alloy melt, dendrites typically have a lower concentration of eutectic formers than the surrounding mother melt and higher concentration of peritectic formers. In the region 16, in the center region upstream of the nip, the small dendrites 14 are thus partially depleted of eutectic formers while the molten metal surrounding the small dendrites is somewhat enriched in eutectic formers. Consequently, the solid central layer 18 of the strip 20, which contains a large population of dendrites, is depleted of eutectic formers (typically by up to about 20 weight percent, such as about 5 to about 20 wt. %) and is enriched in peritectic formers (typically by up to about 45 percent such, as about 5 to about 45 wt. %) in comparison to the concentration of the eutectic formers and the peritectic formers in each of the metal M, the upper shell 6 and the lower shell 8.

When referring to any numerical range of values, such ranges are understood to include each and every number and/or fraction between the stated range minimum and maximum. A range of about 5 to 20 wt. % eutectic formers, for example, would expressly include all intermediate values of about 5.1, 5.2, 5.3 and 5.5%, all the way up to and including 19.5, 19.7 and 19.9 wt. % eutectic formers. The same applies to each other numerical property such as thickness, relative thickness, concentration, and/or process parameter set forth herein.

The rolls $R_1$ and $R_2$ serve as heat sinks for the heat of the molten metal M. In the present invention, heat is transferred from the molten metal M to the rolls $R_1$ and $R_2$ in a uniform manner to ensure uniformity in the surface of the cast strip 20. Surfaces $D_1$ and $D_2$ of the respective rolls $R_1$ and $R_2$ may be made from steel or copper and are textured and include surface irregularities (not shown) which contact the molten metal M. The surface irregularities may serve to increase the heat transfer from the surfaces $D_1$ and $D_2$ and, by imposing a controlled degree of nonuniformity in the surfaces $D_1$ and $D_2$, result in uniform heat transfer across the surfaces $D_1$ and $D_2$. The surface irregularities may be in the form of grooves, dimples, knurls or other structures and may be spaced apart in a regular pattern of about 20 to about 120 surface irregularities per inch or about 60 irregularities per inch. The surface irregularities may have a height of about 5 to about 50 microns or about 30 microns. The rolls $R_1$ and $R_2$ may be coated with a material to enhance separation of the cast strip from the rolls $R_1$ and $R_2$ such as chromium or nickel.

The control, maintenance and selection of the appropriate speed of the rolls $R_1$ and $R_2$ may impact the operability of the present invention. The roll speed determines the speed that the molten metal M advances towards the nip N. If the speed is too slow, the large dendrites 10 will not experience sufficient forces to become entrained in the central portion 12 and break into the small dendrites 14. Accordingly, the present invention is suited for operation at high speeds such as about 25 to about 400 feet per minute or about 100 to about 400 feet per minute or about 150 to about 300 feet per minute. The linear rate per unit area that molten aluminum is delivered to the rolls $R_1$ and $R_2$ may be less than the speed of the rolls $R_1$ and $R_2$ or about one quarter of the roll speed. High-speed continuous casting according to the present invention may be achievable in part because the textured surfaces $D_1$ and $D_2$ ensure uniform heat transfer from the molten metal M.

The roll separating force may be a parameter in practicing the present invention. A significant benefit of the present invention is that solid strip is not produced until the metal reaches the nip N. The thickness is determined by the dimension of the nip N between the rolls $R_1$ and $R_2$. The roll separating force may be sufficiently great to squeeze molten metal upstream and away from the nip N. Excessive molten metal passing through the nip N may cause the layers of the upper and lower shells 6 and 8 and the solid central portion 18 to fall away from each other and become misaligned. Insufficient molten metal reaching the nip N causes the strip to form prematurely as occurs in conventional roll casting processes. A prematurely formed strip 20 may be deformed by the rolls $R_1$ and $R_2$ and experience centerline segregation. Suitable roll separating forces are about 25 to about 300 pounds per inch of width cast or about 100 pounds per inch of width cast. In general, slower casting speeds may be needed when casting thicker gauge aluminum alloy in order to remove the heat from the thick alloy. Unlike conventional roll casting, such slower casting speeds do not result in excessive roll separating forces in the present invention because fully solid aluminum strip is not produced upstream of the nip.

Thin gauge aluminum strip product may be cast according to the method of the present invention. Roll separating force has been a limiting factor in producing low gauge aluminum alloy strip product but the present invention is not so limited because the roll separating forces are orders of magnitude less than in conventional processes. Aluminum alloy strip may be produced at thicknesses of about 0.1 inch or less at casting speeds of 25 to about 400 feet per minute. Thicker gauge aluminum alloy strip may also be produced using the method of the present invention, for example at a thickness of about ¼ inch.

The roll surfaces $D_1$ and $D_2$ heat up during casting and are prone to oxidation at elevated temperatures. Nonuniform oxidation of the roll surfaces during casting can change the heat transfer properties of the rolls $R_1$ and $R_2$. Hence, the roll surfaces $D_1$ and $D_2$ may be oxidized prior to use to minimize changes thereof during casting. It may be beneficial to brush the roll surfaces $D_1$ and $D_2$ from time to time or continuously to remove debris which builds up during casting of aluminum and aluminum alloys. Small pieces of the cast strip may break free from the strip S and adhere to the roll surfaces $D_1$ and $D_2$. These small pieces of aluminum alloy strip are prone to oxidation, which result in nonuniformity in the heat transfer properties of the roll surfaces $D_1$ and $D_2$. Brushing of the roll surfaces $D_1$ and $D_2$ avoids the nonuniformity problems from debris which may collect on the roll surfaces $D_1$ and $D_2$.

The present invention further includes aluminum alloy strip continuously cast according to the present invention. The aluminum alloy strip 20 includes a first layer of an aluminum alloy and a second layer of the aluminum alloy (corresponding to the shells 6 and 8) with an intermediate layer (the solidified central layer 18) therebetween. The concentration of eutectic forming alloying elements in the intermediate layer is less than in the first and second layers, typically by up to about 20 wt. % such as by about 5 to about 20%. The concentration of peritectic forming alloying elements in the intermediate layer is greater than in the first and second layers, typically by up to about 45 wt. % such as by about 5 to about 45%. The grains in the aluminum alloy strip of the present invention are substantially undeformed because the force applied by the rolls is low (300 pounds per inch of width or less). The strip 20 is not solid until it reaches the nip N; hence it is not hot rolled in the manner of conventional twin roll casting and does not receive typical thermo-mechanical treatment. In the absence of conventional hot rolling in the caster, the grains in the strip 20 are substantially undeformed and retain their initial structure achieved upon solidification, i.e. an equiaxial structure, such as globular.

It is contemplated that conventional aluminum alloy roll casters may be retrofitted for operation according to the present invention. The gearbox and associated components of a conventional aluminum alloy roll caster typically cannot accommodate the high speed of roll rotation contemplated according to the present invention. Hence, these roll-driving components may need to be upgraded in order to practice the present invention. A combination of fixed dams and electromagnetic edge dams may be included on a continuous caster operated according to the inventive method. The rolls also should be textured and brushed as described above. Further, the strip may be cooled and supported at the exit to avoid hot shortness and may be subsequently hot rolled before coiling.

Continuous casting of aluminum alloys according to the present invention is achieved by initially selecting the desired dimension of the nip N corresponding to the desired gauge of the strip S. The speed of the rolls $R_1$ and $R_2$ is increased to a desired production rate or to a speed which is less than the speed which causes the roll separating force increases to a level which indicates that rolling is occurring between the rolls $R_1$ and $R_2$. Casting at the rates contemplated by the present invention (i.e. about 25 to about 400 feet per minute) solidifies the aluminum alloy strip about 1000 times faster than aluminum alloy cast as an ingot cast and improves the properties of the strip over aluminum alloys cast as an ingot. Although the invention has been described generally above, the following examples give additional illustration of the product and process steps typical of the present invention.

EXAMPLES

Molten aluminum alloys having alloying elements present in the percentage by weight indicated in Table 1 were continuously cast on a heat sink belt caster where the upper belt did not contact the solidifying metal downstream of the nip.

The tests reported herein were not performed on a roll caster. However, the processes were designed to simulate casting onto a pair of rolls without working the solidified metal.

TABLE 1

| Alloy | Alloying elements (% by weight) |
|---|---|
| 1 | 0.6 Si-1.4 Fe-1.7 Ni-0.6 Zn |
| 2 | 0.9 Mg-0.9 Mn-0.5 Cu-0.45 Fe-0.3 Si |
| 3 | 1.4 Mg-0.25 Mn-0.15 Cu-0.30 Fe-0.4 Si |

Figure 4:
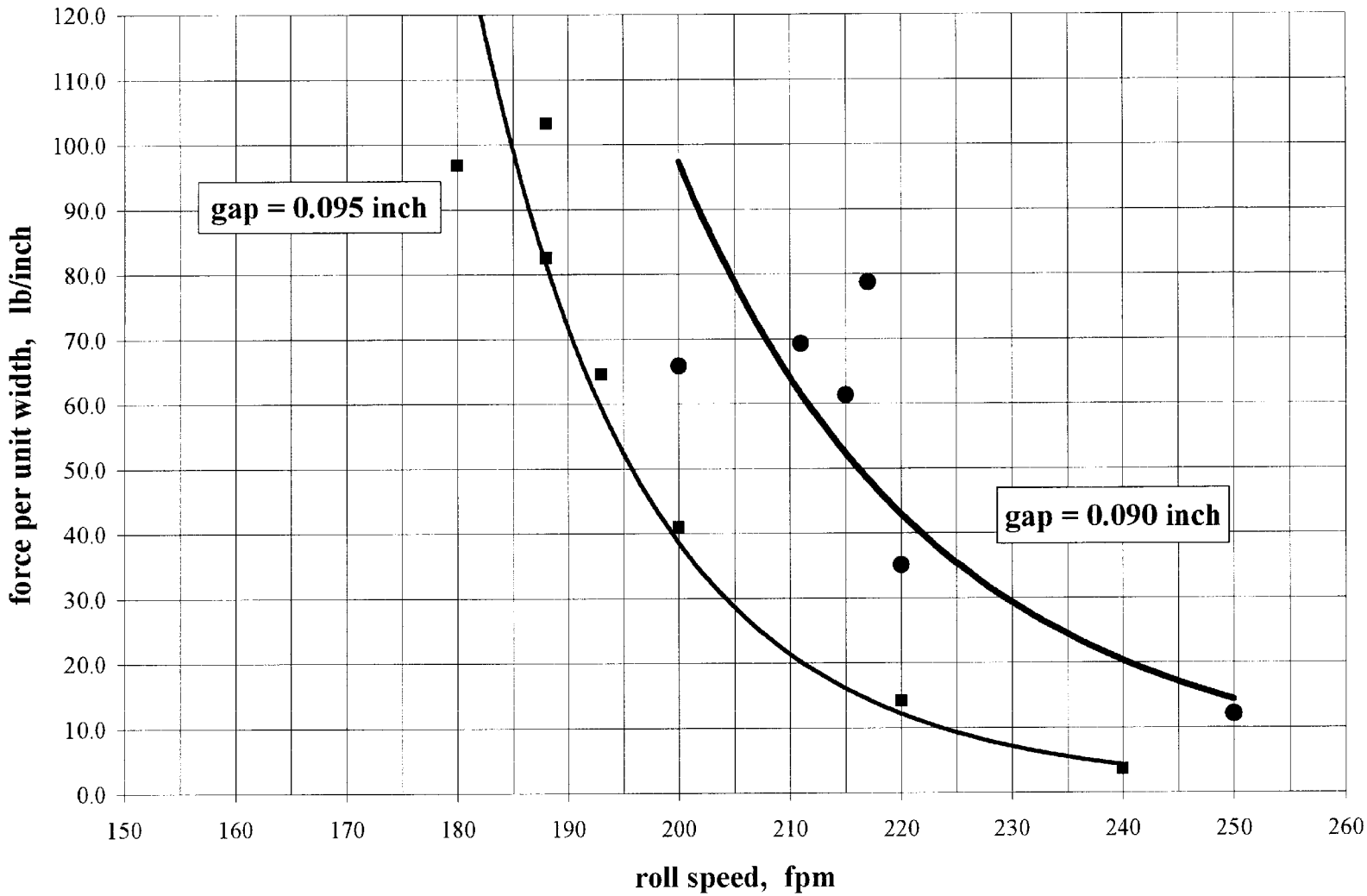
FIG. 4 is a graph of force per unit width versus casting speed for the method of the present invention for an Si—Fe—Ni—Zn aluminum alloy.
Figure 5:
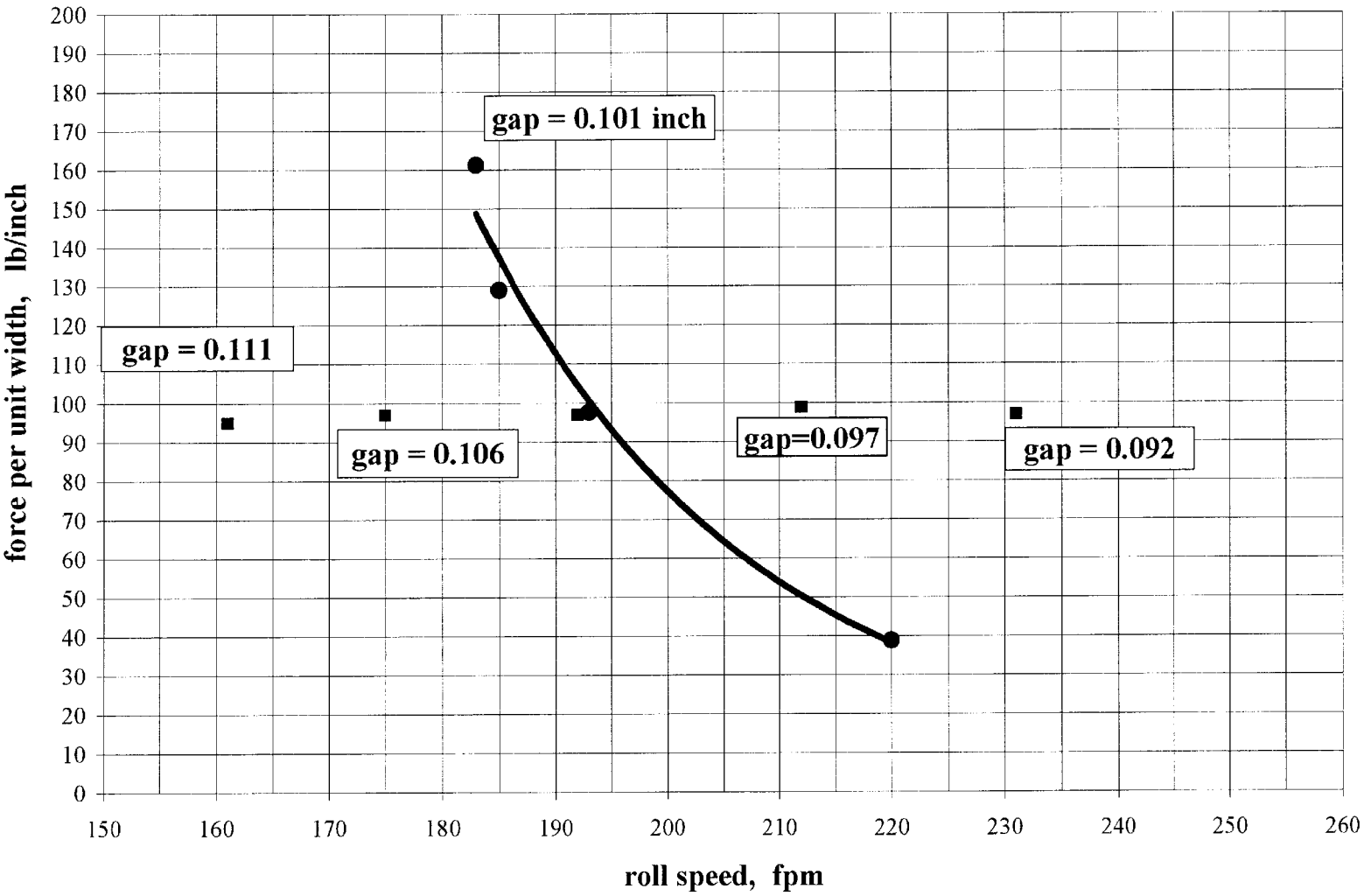
FIG. 5 is a graph of force per unit width versus casting speed for the method of the present invention for a Mg—Mn—Cu—Fe—Si aluminum alloy.

The force per unit width applied to Alloys 1 and 2 versus the roll speed for various gap settings is shown graphically in FIGS. 4 and 5, respectively. In all instances, the force applied by the rolls was less than 200 lbs/inch of width.

Figure 6:
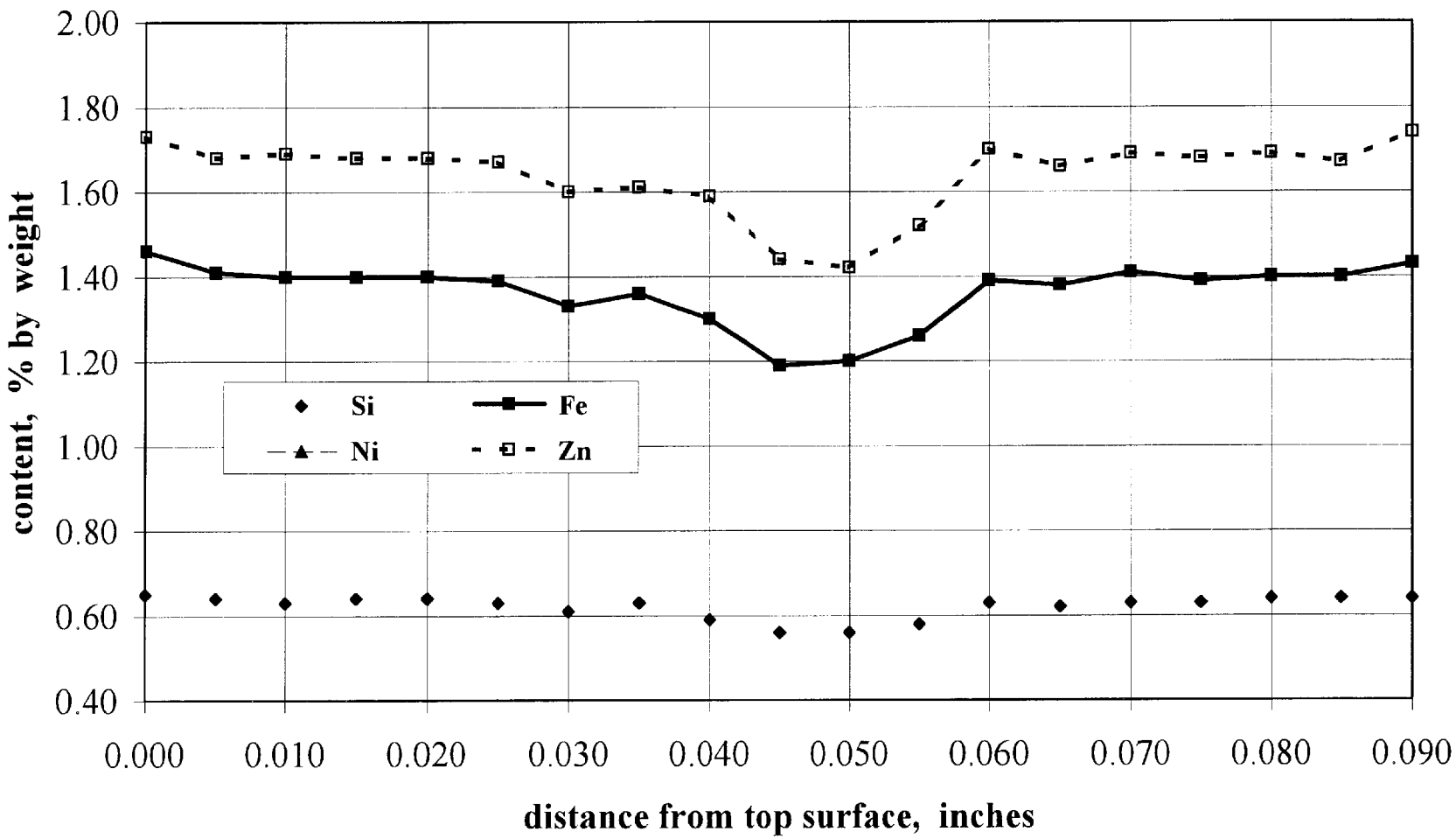
FIG. 6 is a graph of the concentration of eutectic forming alloying elements versus strip depth in a strip of an Si—Fe—Ni—Zn aluminum alloy produced according to the present invention.
Figure 7:
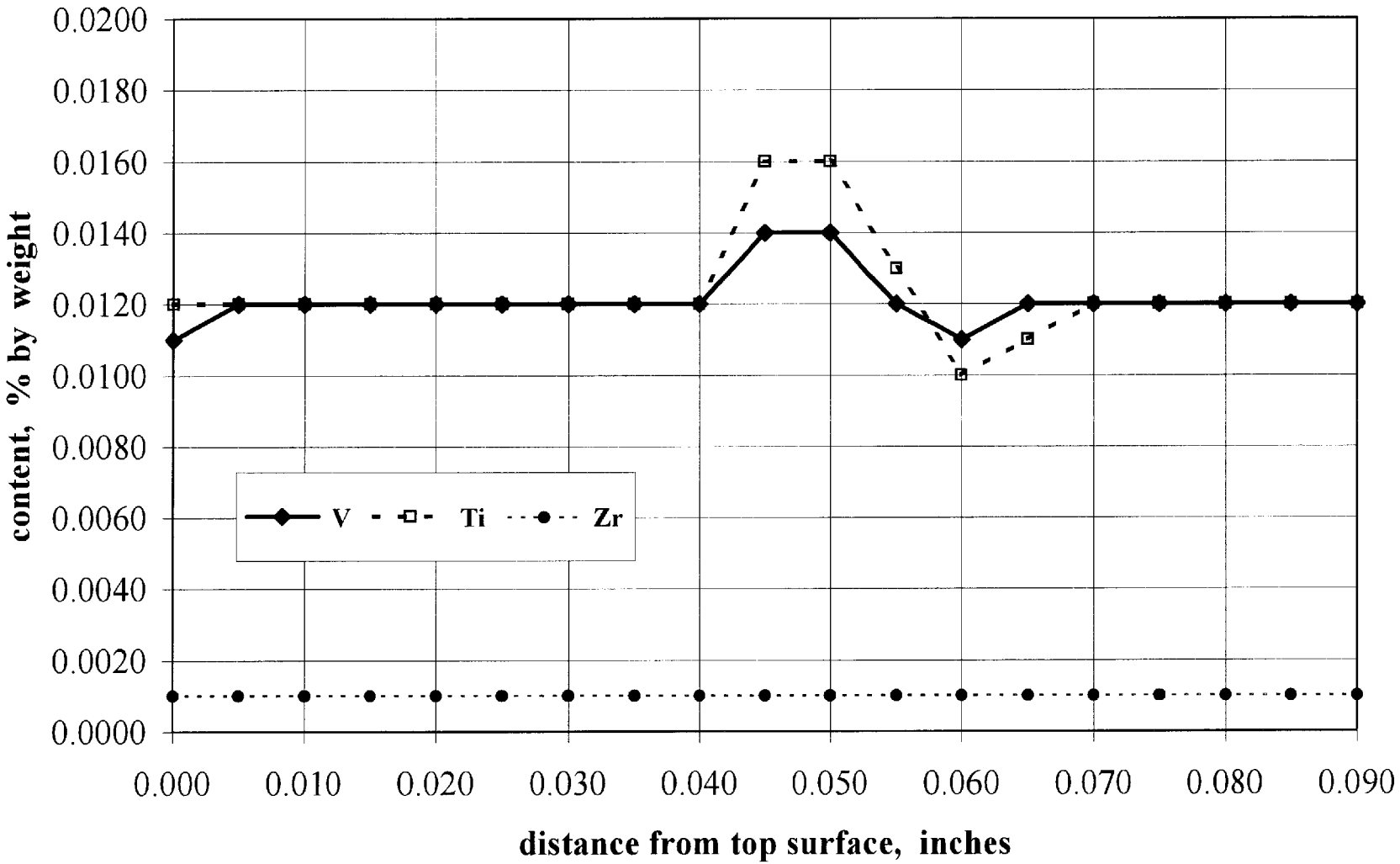
FIG. 7 is a graph of the concentration of peritectic forming alloying elements versus strip depth in the strip of an Si—Fe—Ni—Zn aluminum alloy produced according to the present invention.

A strip of Alloy 1 (0.09 inch thick) was analyzed for segregation of alloying elements. The concentration of alloying elements through the thickness of the strip is presented graphically FIG. 6 for eutectic forming elements (Si, Fe, Ni and Zn) and in FIG. 7 for peritectic forming elements (Ti, V and Zr). The eutectic forming alloying elements are partially depleted in the central portion of the strip while the peritectic forming alloying elements are enriched in the central portion of the strip.

Figure 8A:
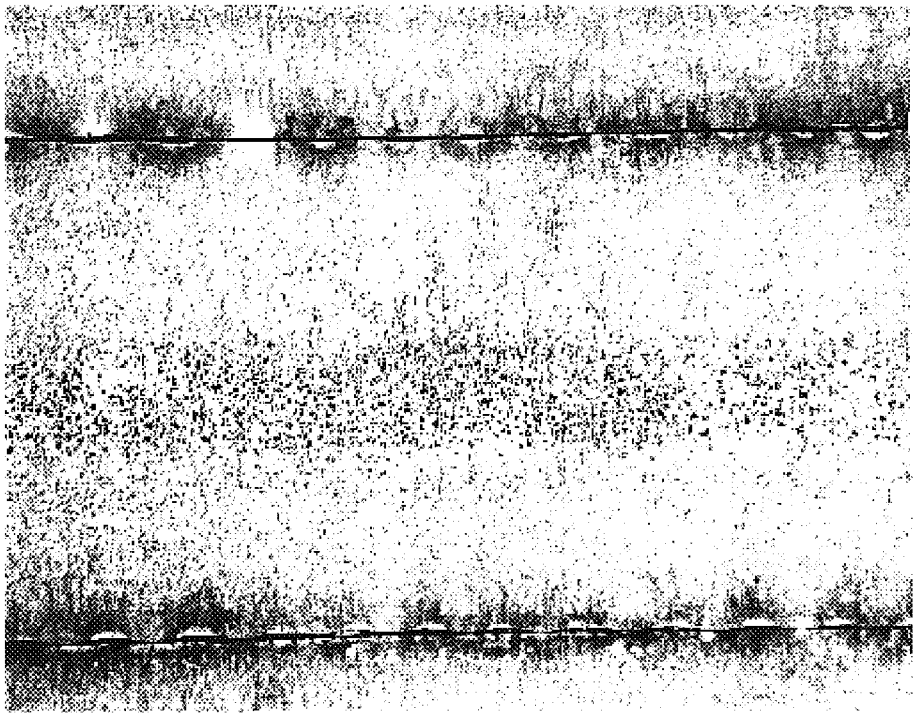
FIG. 8*a* is a photomicrograph at 25 times magnification of a transverse section of the strip of an Si—Fe—Ni—Zn aluminum alloy produced according to the present invention.
Figure 8B:
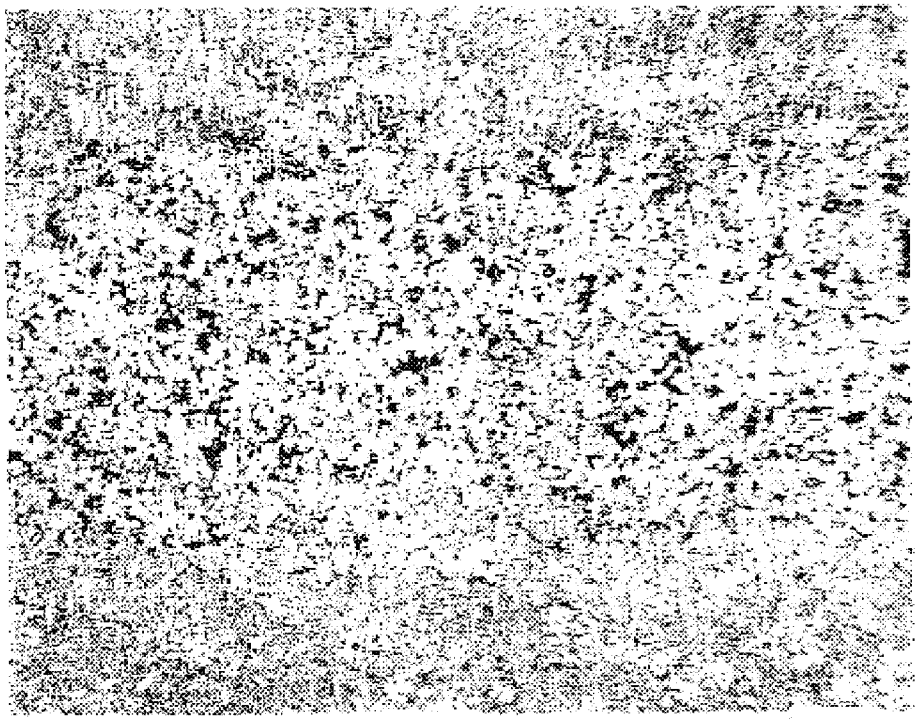
FIG. 8*b* is a photomicrograph at 100 times magnification of the strip shown in FIG. 8*a;*

FIG. 8*a* is a photomicrograph at 25 times magnification of a transverse section through a stack of three strips of Alloy 1 produced at a casting speed of 188 feet per minute, mean strip thickness of 0.094 inch, strip width of 15.5 inches, and applied force of 103 pounds per inch of width. The full thickness of one strip is seen in FIG. 8*a* between a pair of thin, dark bands. The central, darker band in the full strip corresponds to the central layer 18 described above which is partially depleted of eutectic forming alloying elements while the outer, lighter portions of the fall strip correspond to the upper and lower shells 6 and 8 described above. FIG. 8*b* is a photomicrograph of the central strip of FIG. 8*a* at 100 times magnification. The globular nature of the grains in the central, darker band indicates no working of the strip occurred in the caster.

Figure 9A:
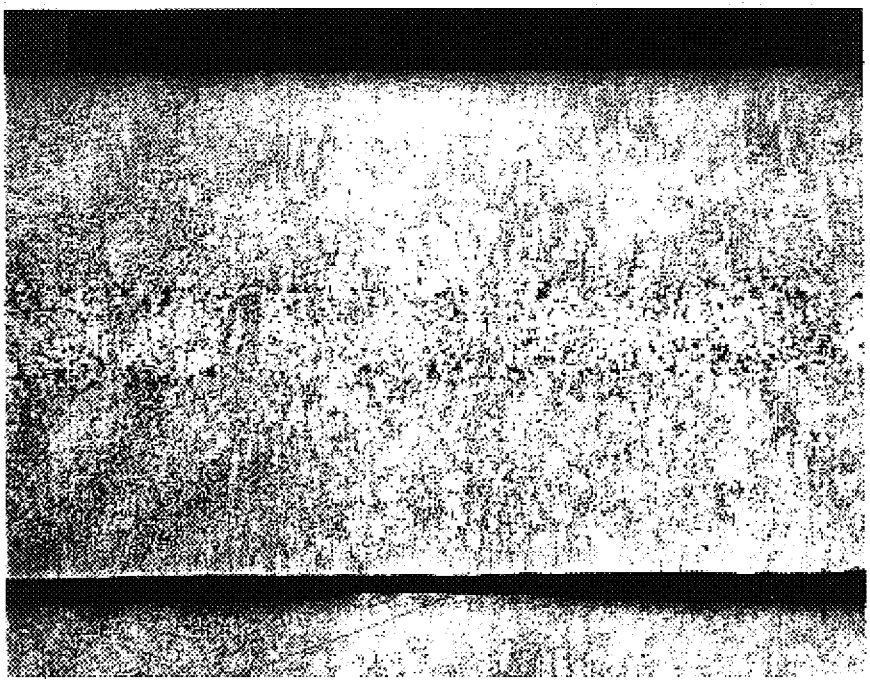
FIG. 9*a* is a photomicrograph at 25 times magnification of a transverse section of the strip of an Mg—Mn—Cu—Fe—Si aluminum alloy produced according to the present invention.
Figure 9B:
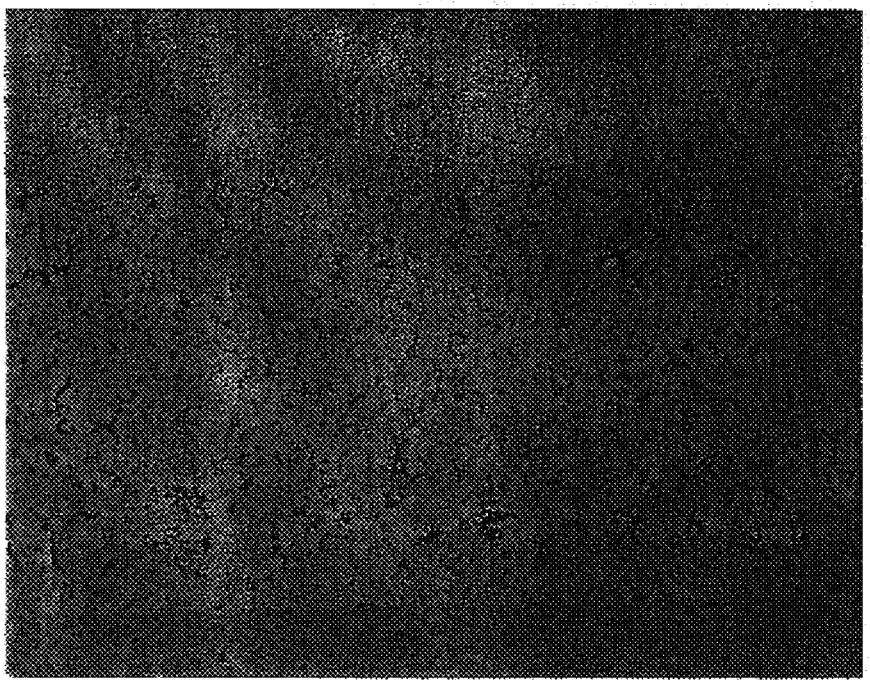
FIG. 9*b* is a photomicrograph at 100 times magnification of the center portion of the strip shown in FIG. 9*a;*

FIG. 9*a* is a photomicrograph at 25 times magnification of a transverse section through a stack of two strips of Alloy 2 produced at a casting speed of 231 feet per minute, roll gap of 0.0925 inch, strip width of 15.5 inches and applied force of 97 pounds per inch of width. The full thickness of one strip and a portion of the other strip are seen in FIG. 9*a*. The strip of FIG. 9*a* also exhibits a central, darker band depleted of eutectic forming alloying elements. FIG. 9*b* is a photomicrograph of the center portion of the strip of FIG. 9*a* at 100 times magnification. The globular nature of the grains in the central, darker band also indicates no working of the strip occurred in the caster.

Figure 10:
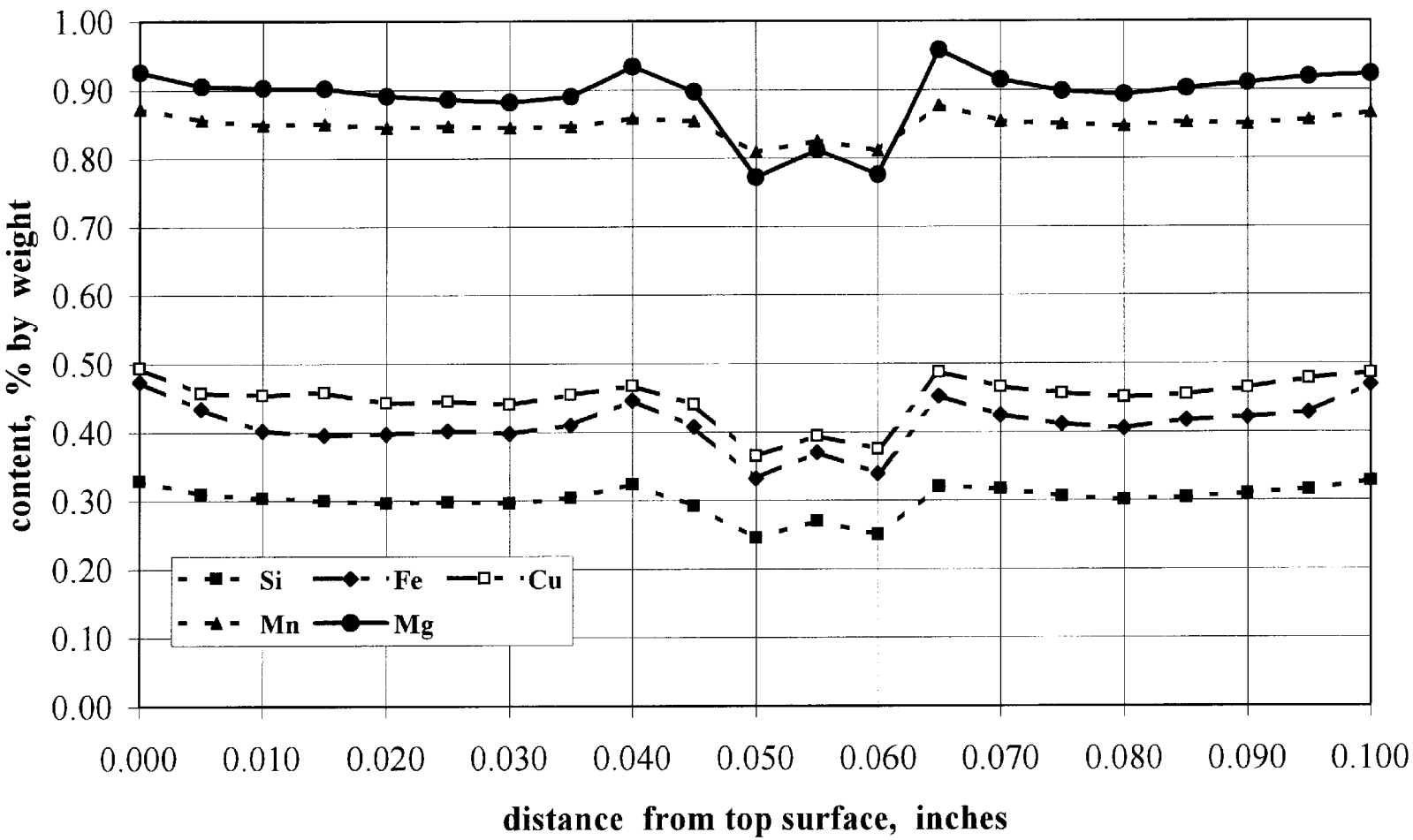
FIG. 10 is a graph of the concentration of eutectic forming alloying elements versus strip depth in a strip of an Mg—Mn—Cu—Fe—Si aluminum alloy produced according to the present invention.
Figure 11:
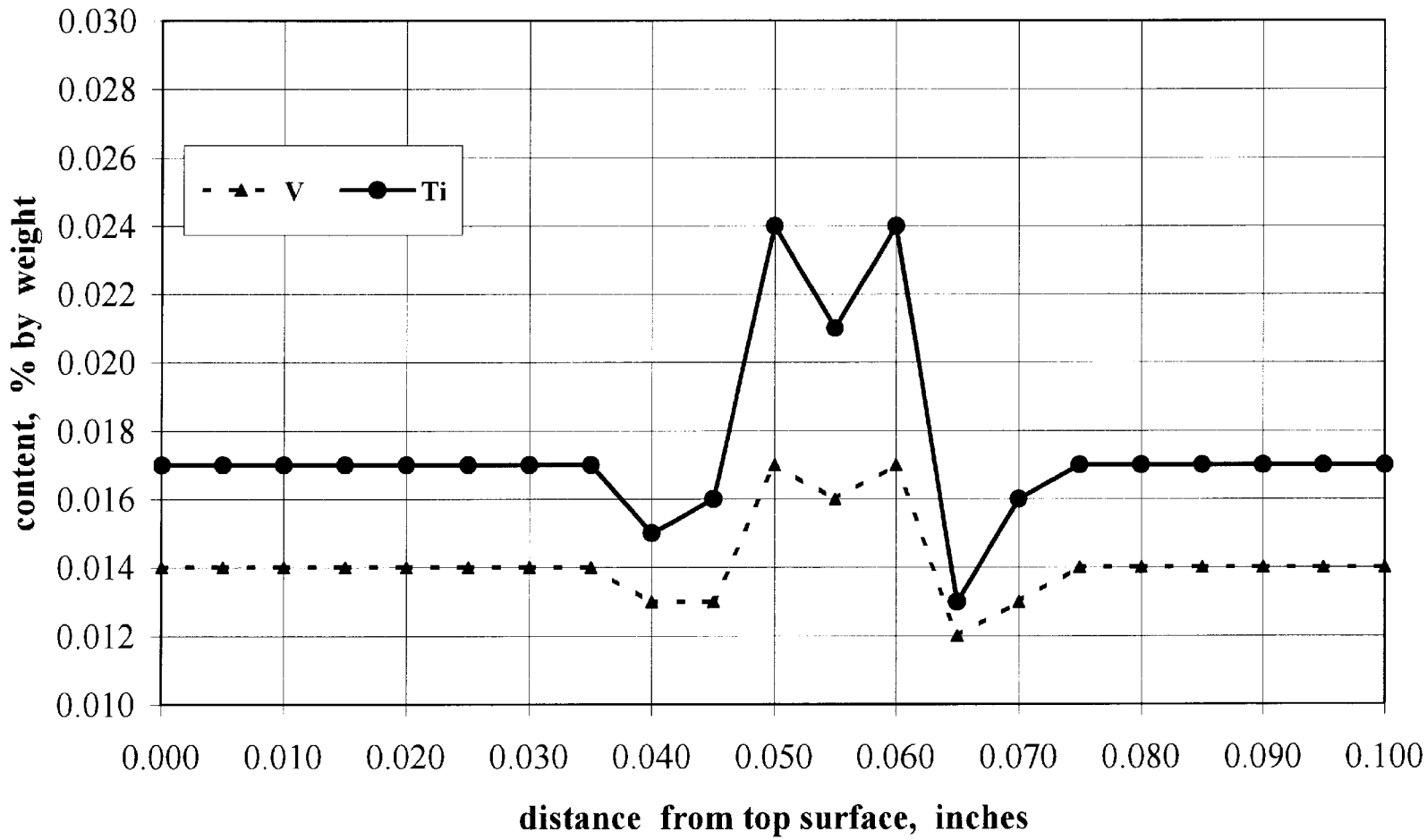
FIG. 11 is a graph of the concentration of peritectic forming alloying elements versus strip depth in the strip of an Mg—Mn—Cu—Fe—Si aluminum alloy produced according to the present invention.

A strip of Alloy 2 (0.1 inch thick) was analyzed for segregation of alloying elements. The concentration of alloying elements through the thickness of the strip is presented graphically in FIG. 10 for eutectic forming elements (Mg, Mn, Cu, Fe and Si) and in FIG. 11 for peritectic forming elements (Ti and V). The eutectic forming alloying elements are partially depleted in the central portion of the strip while the peritectic forming alloying elements are enriched in the central portion of the strip.

Figure 12:
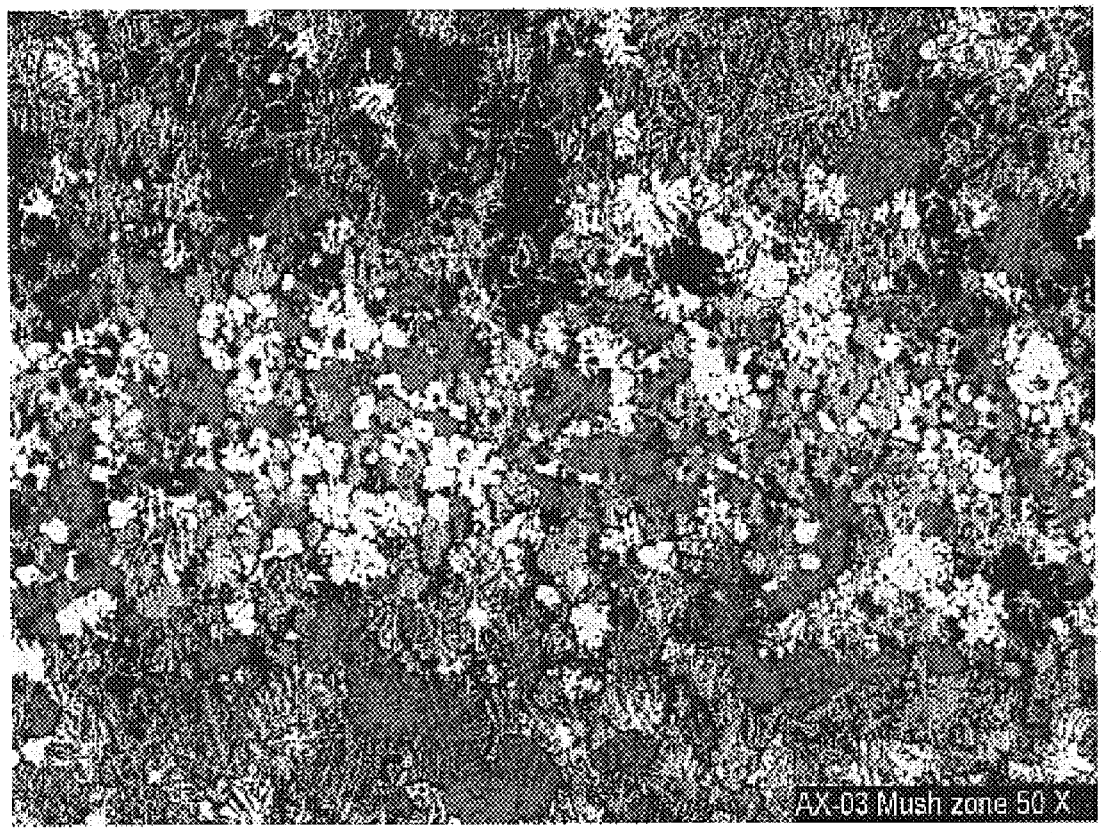
FIG. 12 is a photomicrograph at 50 times magnification of a transverse center section of the anodized strip of an Mg—Mn—Cu—Fe—Si aluminum alloy produced according to the present invention.

FIG. 12 is a photomicrograph at 50 times magnification of a transverse section through an anodized strip of Alloy 3 produced at a casting speed of 196 feet per minute, mean strip thickness of about 0.098 inch, strip width of 15.6 inches, and applied force of 70 pounds per inch of width. The photomicrograph shows the central portion of the strip sandwiched between upper and lower portions without showing the top and bottom surfaces of the strip The central, lighter band in the strip corresponds to the central layer 18 described above which is partially depleted of eutectic forming alloying elements while the outer, darker portions of the full strip correspond to the upper and lower shells 6 and 8 described above. The grains shown in the strip are globular, indicating absence of working thereof.

Figure 13A:
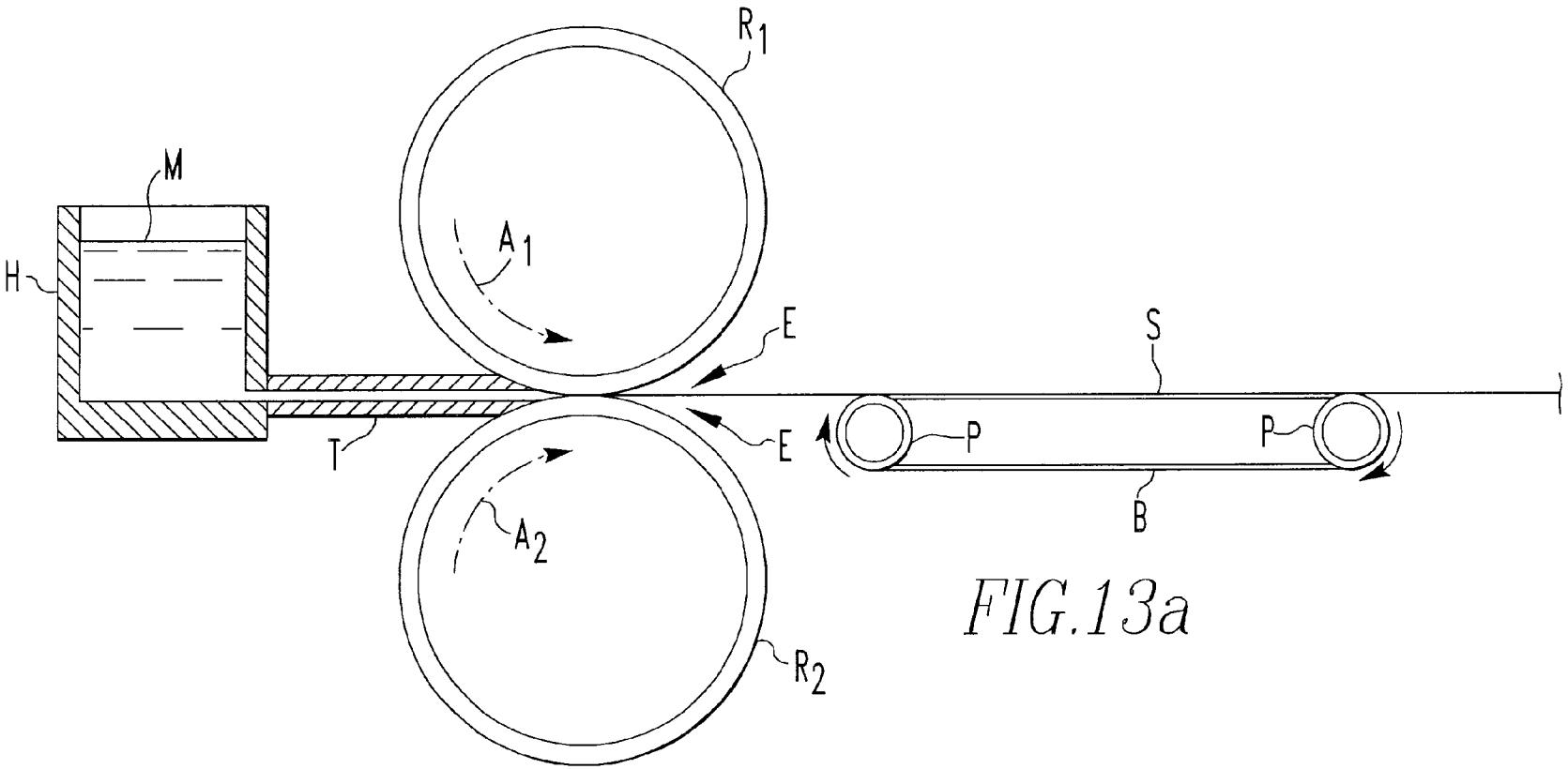
FIG. 13*a* is a schematic of a caster made in accordance with the present invention with a strip support mechanism and optional cooling means.
Figure 13B:
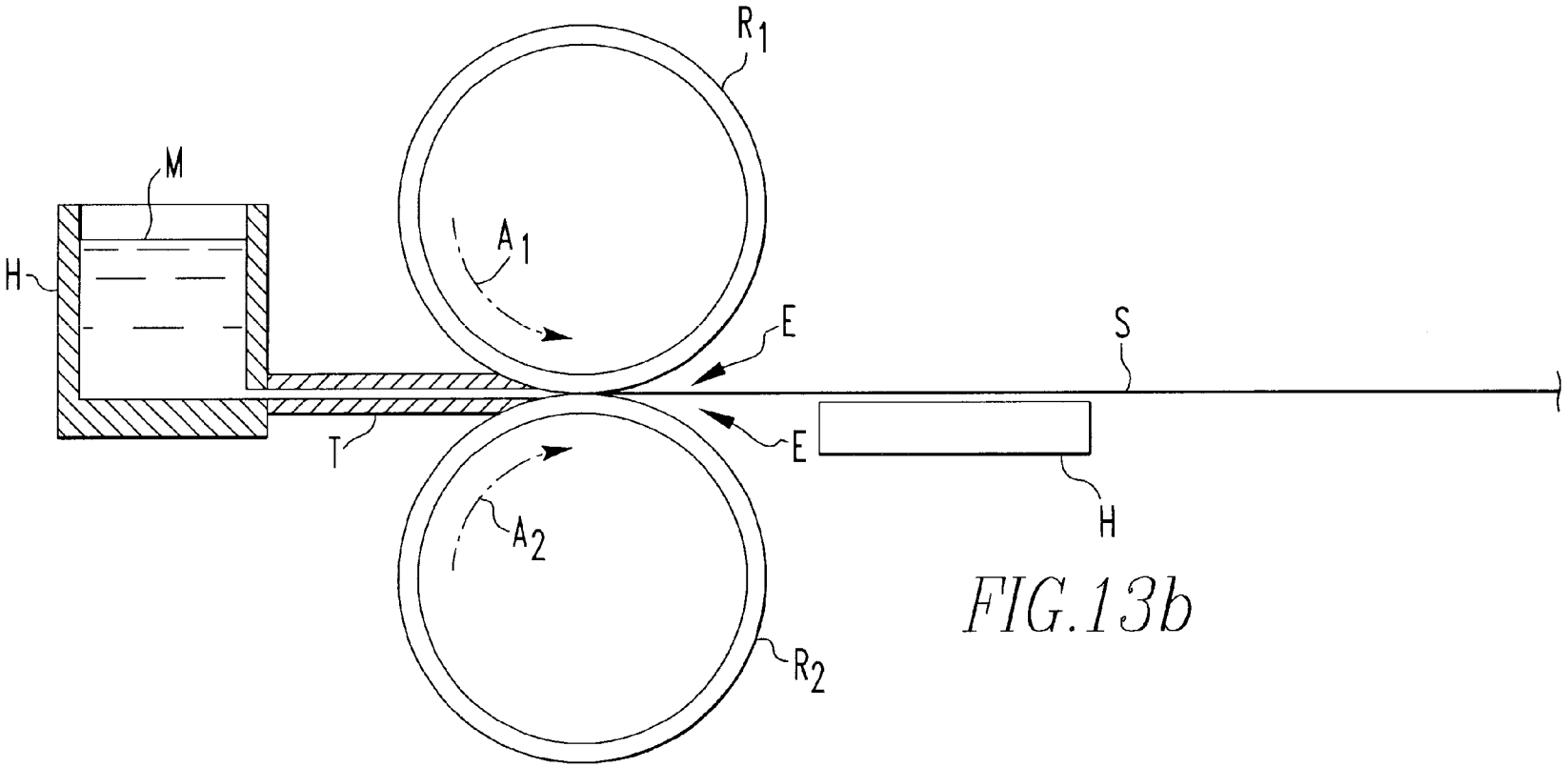
FIG. 13*b* is a schematic of a caster made in accordance with the present invention with another strip support mechanism and optional cooling means.

In practicing the present invention it may be beneficial to support the hot strip S exiting the rolls $R_1$ and $R_2$ until the strip S cools sufficiently to be self-supporting. One support mechanism shown in FIG. 13*a* includes a continuous conveyor belt B positioned beneath the strip S exiting the rolls $R_1$ and $R_2$. The belt B travels around pulleys P and supports the strip S for a distance that may be about 10 feet. The length of the belt B between the pulleys P may be determined by the casting process, the exit temperature of the strip S and the alloy of the strip S. Suitable materials for the belt B include fiberglass and metal (e.g. steel) in solid form or as a mesh. Alternatively, as shown in FIG. 13*b* the support mechanism may include a stationary support surface H such as a metal shoe over which the strip S travels while it cools. The shoe H may be made of a material to which the hot strip S does not readily adhere. In certain instances where the strip S is subject to breakage upon exiting the rolls $R_1$ and $R_2$, the strip S may be cooled at locations E with a fluid such as air or water. Typically, the strip S exits the rolls $R_1$ and $R_2$ at about 1100° F. It may be desirable to lower the strip temperature to about 1000° F. within about 8 to 10 inches of the nip N. One suitable mechanism for cooling the strip at locations E to achieve that amount of cooling is described in U.S. Pat. No. 4,823,860, incorporated herein by reference.

It will be readily appreciated by those skilled in the art that modifications may be made to the invention without departing from the concepts disclosed in the foregoing description. Such modifications are to be considered as included within the following claims unless the claims, by their language, expressly stated otherwise. Accordingly, the particular embodiments described in detail herein are illustrative only and are not limiting to the scope of the invention which is to be given the full breadth of the appended claims and any and all equivalents thereof.

I claim:

1. A method of continuously casting aluminum alloy strip comprising the steps of:

providing a pair of rolls defining a nip therebetween;

delivering molten aluminum alloy to the rolls;

rotating the rolls to advance the molten aluminum alloy towards the nip;

solidifying the molten aluminum alloy to produce a solid outer layer of aluminum alloy adjacent each roll and a semi-solid central layer of aluminum alloy between the solid layers;

advancing the solid outer layers and the semi-solid central layer into the nip;

solidifying the central layer within the nip to produce a solid strip of aluminum alloy comprising the central layer and the outer layers; and withdrawing a strip of solid aluminum alloy from the nip, wherein the molten aluminum alloy has an initial concentration of eutectic forming alloying elements and the concentration of eutectic forming alloying elements in the central layer is less than the initial concentration of the eutectic forming alloying elements.

2. The method of claim 1 wherein the semi-solid central layer includes a solid component and a molten component, the molten component being urged upstream from the nip.

3. The method of claim 1 wherein the concentration of the eutectic forming alloying elements in the central layer is less than the concentration of the eutectic forming alloying elements in each of the outer layers.

4. The method of claim 3 wherein the concentration of the eutectic forming alloying elements in the central layer is about 5 to about 20% less than the concentration of the eutectic forming alloying elements in each of the outer layers.

5. The method of claim 1 wherein the molten aluminum alloy has an initial concentration of peritectic forming alloying elements and the concentration of peritectic forming alloying elements in the central layer is greater than the initial concentration of the peritectic forming alloying elements.

6. The method of claim 5 wherein the concentration of the peritectic forming alloying elements in the central layer is greater than the concentration of the peritectic forming alloying elements in each of the outer layers.

7. The method of claim 6 wherein the concentration of the peritectic forming alloying elements in the central layer is about 5 to about 45% greater than the concentration of the peritectic forming alloying elements in each of the outer layers.

8. The method of claim 1 wherein the strip of metal exits the nip at a rate of over about 25 to about 400 feet per minute.

9. The method of claim 8 wherein the strip of metal exits the nip at a rate of over about 100 to about 300 feet per minute.

10. The method of claim 8 wherein the force applied by the rolls to the aluminium alloy passing through the nip is about 25 to about 300 pounds per inch of width of the strip.

11. The method of claim 1 wherein the force applied by the rolls to the aluminum alloy passing through the nip is about 25 to about 300 pounds per inch of width of the strip.

12. The method of claim 11 wherein a roll separating force applied by the rolls to the aluminum alloy passing through the nip is about 25 to about 200 pounds per inch of width of the strip.

13. The method of claim 12 wherein the force applied by the rolls to the aluminum alloy passing through the nip is about 100 pounds per inch of width of the strip.

14. The method of claim 1 wherein the solid strip has a thickness of about 0.07 to about 0.25 inch.

15. The method of claim 1 wherein a linear speed at which the solid strip is withdrawn from the nip is greater than the linear rate at which the molten aluminum alloy is delivered to the rolls.

16. The method of claim 15 wherein the linear speed at which the solid strip is withdrawn from the nip is about four times greater than the linear rate at which the molten aluminum alloy is delivered to the rolls.

17. The method of claim 1 wherein the strip exits the nip horizontally.

18. The method of claim 1 wherein the rolls each have a textured surface.

19. The method of claim 18 wherein the textured surface includes a plurality of surface irregularities having a height of about 5 to about 50 microns.

20. The method of claim 19 wherein the surface irregularities are spaced apart in a regular pattern of about 20 to about 120 irregularities per inch.

21. The method of claim 20 wherein the surface irregularities comprises grooves, dimples or knurls defined in the roll surface.

22. The method of claim 18 further comprising brushing the textured surfaces of the rolls.

23. The method of claim 1 wherein the rolls comprise a coating of a material to enhance separation of the strip from the rolls.

24. The method of claim 23 wherein the roll coating comprises chromium or nickel.

25. The method of claim 18 further comprising providing a fixed edge dam or an electromagnetic dam or both adjacent the molten metal.

26. The method of claim 1 wherein said step of delivering molten metal comprises positioning a delivery tip containing the molten metal a distance of about 0.02 inch from the rolls.

27. A strip of aluminum alloy comprising:

a pair of outer layers of an aluminum alloy; and a central layer of said aluminum alloy positioned between said outer layers, said outer layers and said central layer having been produced into a strip by continuous casting of a molten aluminum alloy composition between a pair of rolls, the molten aluminum alloy comprising eutectic forming alloying elements in an initial concentration, wherein the concentration of said eutectic forming alloying elements in said central layer is less than the concentration of said eutectic forming alloying elements in each said outer layer.

28. The strip of claim 27 wherein the concentration of said eutectic forming alloying elements in said central layer is about 5 to about 20% less than the concentration of said eutectic forming alloying elements in each said outer layer.

29. The strip of claim 27 wherein the concentration of said eutectic forming alloying elements in said central layer is less than the initial concentration of said eutectic forming alloying elements.

30. The strip of claim 27 wherein said eutectic forming alloying elements are selected from the group consisting of Si, Fe, Ni, Zn, Mg, Cu and Mn.

31. The strip of claim 27 wherein the molten aluminum alloy comprises peritectic forming alloying elements in an initial concentration and the concentration of said peritectic forming alloying elements in said central layer is greater than the concentration of said peritectic forming alloying elements in each said outer layer.

32. The strip of claim 31 wherein the concentration of said peritectic forming alloying elements in said central layer is about 5 to about 45% greater than the concentration of said eutectic forming alloying elements in each said outer layer.

33. The strip of claim 31 wherein the concentration of said peritectic forming alloying elements in said central layer is greater than the initial concentration of said peritectic forming alloying elements.

34. The strip of claim 27 wherein said peritectic forming alloying elements are selected from the group consisting of Ti, Cr, V and Zr.

35. The strip of claim 27 wherein the thickness of said strip is about 0.07 to about 0.25 inch.

36. The strip of claim 35 wherein the thickness of said central layer comprises about 20 to about 30% of the thickness of said strip.

37. The strip of claim 27 wherein said central layer comprises globular dendrites.

38. The strip of claim 37 wherein said globular dendrites are unworked.

39. A strip of aluminum alloy comprising:

a pair of outer layers of an aluminum alloy; and a central layer of said aluminum alloy positioned between said outer layers and comprising globular dendrites, said outer layers and said central layer having been produced into a strip by continuous casting of a melt of said aluminum alloy composition delivered to a pair of rotating rolls, wherein the concentration of eutectic forming alloying elements in said dendrites is less than the concentration of eutectic forming alloying elements in said outer layers.

40. The strip of claim 39 wherein the thickness of said strip is about 0.07 to about 0.25 inch.

41. The strip of claim 40 wherein the thickness of said central layer comprises about 20 to about 30% of the thickness of said strip.

42. The strip of claim 41 wherein said globular dendrites are unworked.

43. The strip of claim 39 wherein the concentration of peritectic forming alloying elements in said dendrites is greater than the concentration of peritectic forming alloying elements in said outer layers.

* * * * *